United States Patent [19]

Coles

[11] 4,372,269

[45] Feb. 8, 1983

[54] INTERNAL COMBUSTION ENGINE

[76] Inventor: Donald K. Coles, 2505 Capitol Ave., Fort Wayne, Ind. 46806

[21] Appl. No.: 238,253

[22] Filed: Feb. 25, 1981

Related U.S. Application Data

[63] Continuation-in-part of Ser. No. 200,369, Oct. 24, 1980, Pat. No. 4,366,793.

[51] Int. Cl.[3] ..... F02D 5/00

[52] U.S. Cl. ..... 123/436; 123/487

[58] Field of Search ..... 123/436, 435, 419, 487

[56] References Cited

U.S. PATENT DOCUMENTS

| | | | |
|---|---|---|---|
| 3,789,816 | 2/1974 | Taplin et al. | 123/436 |
| 3,835,819 | 9/1974 | Anderson, Jr. | 123/486 |
| 3,972,230 | 8/1976 | Hanson et al. | 73/116 |
| 4,044,235 | 8/1977 | Frobenius | 123/436 |
| 4,044,236 | 8/1977 | Bianchi et al. | 123/436 |
| 4,064,747 | 12/1977 | Rackliffe et al. | 73/116 |
| 4,092,955 | 6/1978 | Reddy | 123/419 |
| 4,104,990 | 8/1978 | Frobenius | 123/436 |
| 4,140,083 | 2/1979 | Frobenius | 123/436 |
| 4,179,922 | 12/1979 | Bouverie et al. | 73/116 |
| 4,188,920 | 2/1980 | Bianchi et al. | 123/436 |
| 4,329,960 | 5/1982 | Woodhouse et al. | 123/436 |

OTHER PUBLICATIONS

H. Eisele, SAE Publication, P-57, 1974, pp. 81-88.

Gorille et al., SAE Publication SP-393, 1975, pp. 137-144.

Spilski et al., SAE Publication SP-393, 1975, pp. 145-154.

D. Hagen, SAE Publication P-76, 1978, pp. 59-63.

Meyer et al., SAE Publication SP-90, Paper B-4-1, 1980, pp. 1-7.

*Primary Examiner*—Tony M. Argenbright

*Assistant Examiner*—Andrew M. Dolinar

[57] ABSTRACT

A spark-ignition engine has adaptive adjustment of the size of its fuel rations in dependence on misfires in the engine. A misfire is identified as an abnormal deficiency in energy conversion, this being detected by means of a mechanical energy discriminator which compares the quanta of energy derived from different combustion cycles.

The preferred embodiment is a single cylinder engine having a fuel injector valve. The valve is normally closed, being opened for a short interval during each combustion cycle. The size of a fuel ration is regulated by varying the duration of opening of the valve. The duration of opening of the valve is automatically adjusted in dependence on the frequency of misfires in the cylinder. A misfire is detected by means of a decelerometer which compares engine speeds during successive combustion cycles. When a misfire is detected, the fuel rations are automatically increased. Increase of fuel rations is counteracted by gradually decreasing the fuel rations when the engine is firing without an excessive frequency of misfires. Electrical simulation of engine dynamics allows detection of misfires over a wide range of engine speeds and air intake pressures.

3 Claims, 8 Drawing Figures

INTERNAL COMBUSTION ENGINE

CROSS REFERENCE TO RELATED APPLICATION

This is a continuation-in-part of my copending application Ser. No. 200,369 filed Oct. 24, 1980 now U.S. Pat. No. 4,366,793.

BACKGROUND OF THE INVENTION

1. Field of the Invention

A spark-ignition engine has self-adaptive adjustment of the size of its fuel rations, in dependence on misfires in the engine.

2. Description of the Prior Art

It has been found that the specific fuel consumption of a spark-ignition engine can be reduced by burning a lean fuel-air mixture. If the mixture is too lean, however, the engine will misfire on some of its combustion cycles. Excessive misfiring will increase the specific fuel consumption and the atmospheric emission of unburned hydrocarbons. Thus it is important for both fuel economy and low atmospheric pollution that the fuel-to-air ratio be maintained within a rather narrow range.

One method for rationing fuel and air in the correct ratio is to use a carburetor. In the carburetor a fuel reservoir at atmospheric pressure supplies fuel to the air stream through a metering orifice, the pressure drop across the metering orifice being produced by the rush of the air stream through a Venturi tube.

Other methods for rationing fuel employ continuous or timed fuel injection, in which the pressure in a fuel reservoir is kept well above atmospheric pressure. A separate fuel metering orifice is commonly used for each cylinder, the fuel entering the air stream immediately in front of the air intake valve for that cylinder. In the case of timed fuel injection, an on-off valve is associated with each metering orifice, the size of the fuel ration being varied by changing the length of time that its valve is open during each combustion cycle.

These methods of rationing fuel require metering orifices whose flow characteristics are constant in time. However, during the life of the engine the metering orifices may become fouled so that their flow characteristics change, seriously affecting the engine's specific fuel consumption and atmospheric emission. It is then necessary to test and adjust or to replace the metering orifices.

Self-adaptive apparatus for regulating the fuel-to-air ratios of a multicylinder engine are disclosed in my copending patent application Ser. No. 200,369, filed Oct. 24, 1980. These apparatus automatically vary the fuel-to-air ratio in each individual cylinder in dependence on misfires in that cylinder. Misfires in a particular cylinder are detected by comparing the energy of its explosion with the energy of explosions in other cylinders.

SUMMARY OF THE INVENTION

A spark-ignition internal combustion engine has self-adaptive adjustment of the size of its fuel rations in dependence on misfires in the engine. A misfire in a combustion cycle is identified by means of a mechanical energy discriminator which compares the energy derived from that combustion cycle to the energy derived from other combustion cycles of the same cylinder. In the preferred embodiment, which is a single cylinder engine, the energy discriminator identifies a misfire by an excessive deceleration of engine speed followed by a reduction of the deceleration to a small or negative value. The cylinder has a timed fuel injection valve and a mixturastat for regulating the duration of opening of the injection valve. When a misfire takes place in the cylinder, the duration of opening of its fuel injector valve is automatically increased. Excessive increase in fuel rations is prevented by a counteracting decrease in fuel rations when the cylinder is not misfiring excessively.

Engine dynamics are simulated electronically so that misfires can be detected and used to adjust the fuel-to-air ratio over a large range of engine speeds and intake air pressures.

Objects of my invention are to improve fuel economy of engines and to reduce atmospheric pollution, while reducing the cost of maintaining the fuel metering equipment.

DESCRIPTION OF THE PREFERRED EMBODIMENT

My engine has a single cylinder fitted with a piston. The piston is attached to a connecting rod which drives a crankshaft serving as a power output shaft. The cylinder has an air inlet valve and an exhaust valve. Air reaches the cylinder through an induction tube with an air throttle valve at its entrance. The piston speed is kept low to reduce pumping losses and loss of volumetric efficiency. The power output shaft drives a propeller.

Liquid fuel is rationed by a metering valve, with timed fuel injection into the cylinder through its air inlet valve, while it is open to admit air. The mixture of air and fuel in the cylinder is compressed by the piston and ignited by a spark near the end of the compression strokes. A block diagram of the fuel metering apparatus is shown in FIG. 1.

Figure 1:
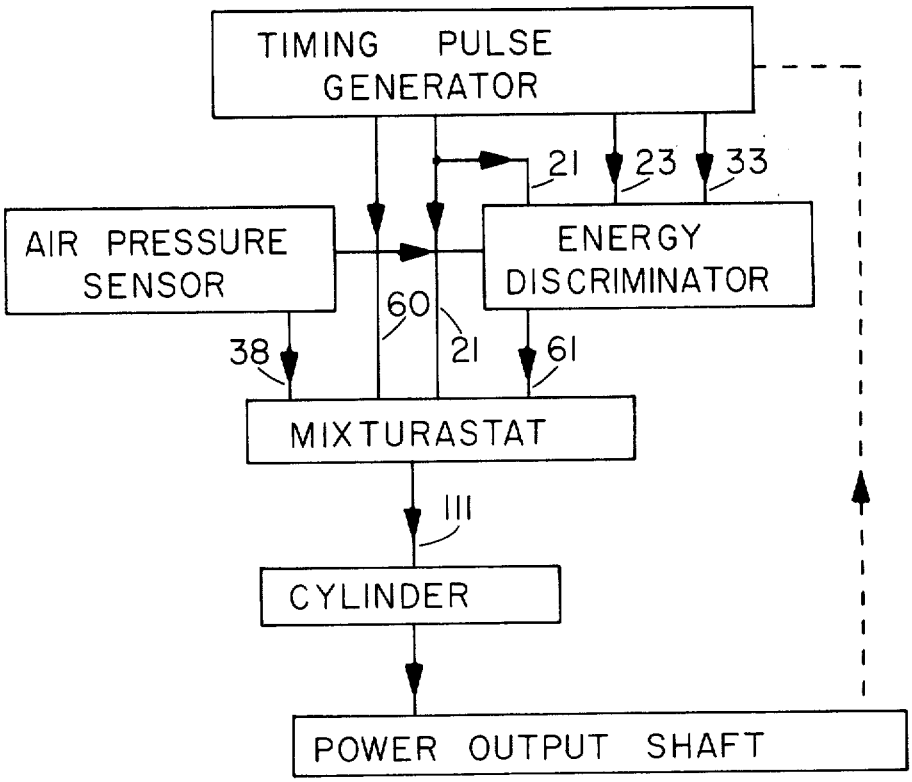
FIG. 1 is a block diagram of the fuel rationing system.

Referring to FIG. 1, the Timing Pulse Generator, driven from the POWER OUTPUT SHAFT, provides pulses for measuring engine speed and for initiating fuel injection into the cylinder. The AIR PRESSURE SENSOR contains an oscillator which transmits to the MIXTURASTAT a high frequency signal whose period is proportional to the air pressure in the induction tube. The MIXTURASTAT regulates the fuel-to-air ratio for the CYLINDER. Energy output from the CYLINDER is transmitted to the POWER OUTPUT SHAFT. The ENERGY DISCRIMINATOR receives pulses from the TIMING PULSE GENERATOR and AIR PRESSURE SENSOR and transmits derived signals to the MIXTURASTAT.

Figure 2:
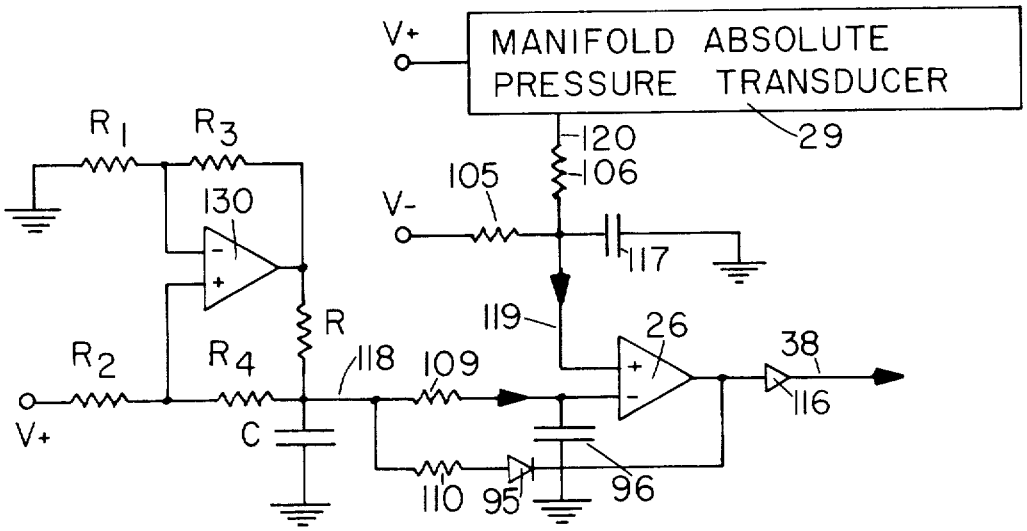
FIG. 2 diagrams the air pressure sensor.

The AIR PRESSURE SENSOR is diagramed in FIG. 2. The TIMING PULSE GENERATOR is diagramed in FIG. 3; the ENERGY DISCRIMINATOR is diagramed in FIG. 5. The MIXTURASTAT is show in FIG. 8.

Figure 3:
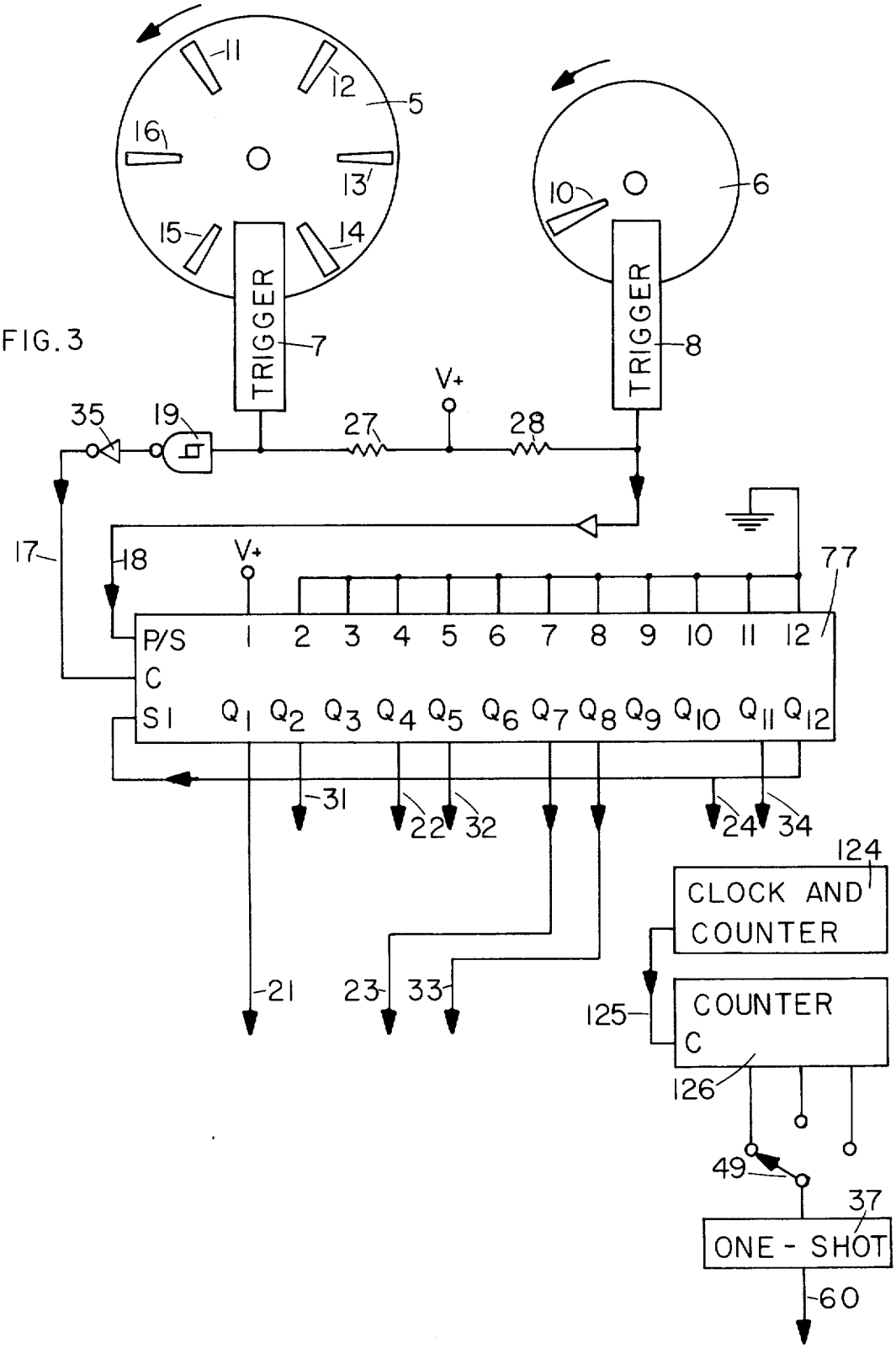
FIG. 3 diagrams the timing pulse generator.

Referring to FIG. 3, photoelectric triggers 7,8 sense the passage of slots in slotted disks 5,6 respectively. Disk 5 is used to time shaft speed and to initiate fuel injection. This disk is attached to the crankshaft and rotates with it. Slots 11–16 are spaced sixty degrees apart. Slot 11 passes trigger 7 near top dead center for the piston.

Disk 6, which rotates at one half crankshaft speed, is used to synchronize electric counters with the engine valving. Slot 10 passes trigger 8 slightly after slot 11 passes trigger 7, while the air inlet valve to the cylinder is open.

The output leads from triggers 7,8 are normally grounded within the triggers, but during the instant that a slot passes one of the triggers its output is open-circuited. This action allows the trigger output to be pulled up momentarily to the upper power supply potential (which may be 8 to 12 volts) by pullup resistor 27 or 28. When one of slots 11–16 passes trigger 7, its positive output pulse is sharpened by Schmitt trigger 19 and buffer 35, then transmitted on lead 17 to the clock input of shift register 77.

Figure 4:
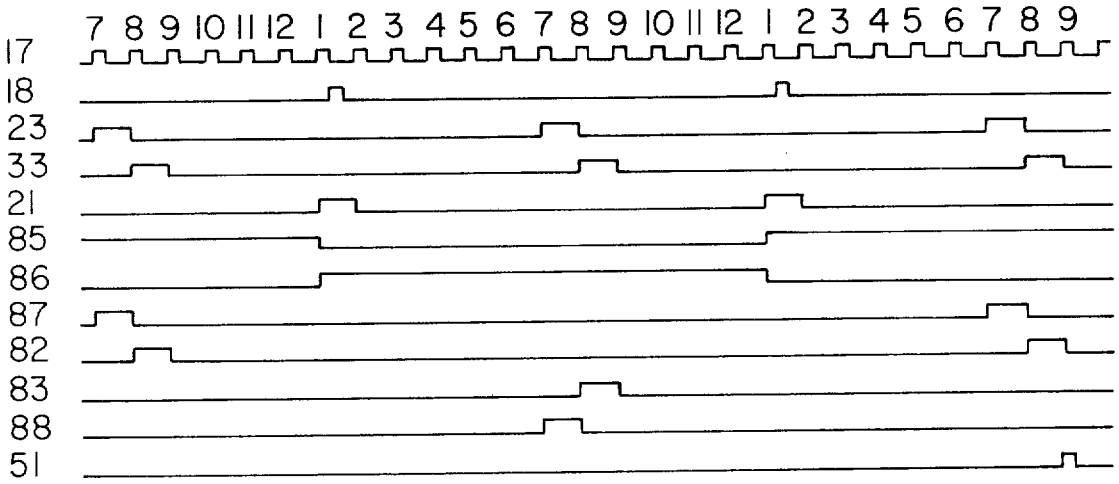
FIG. 4 indicates the timing of pulses from the timing pulse generator.

The output of the twelfth stage of register 77 is fed back to its serial input, so that the register becomes a divide-by-12 ring counter. The counter is synchronized with the engine valving by means of parallel data inputs, enabled by a pulse transmitted on lead 18 from trigger 8. Timing of the output pulses on leads 17,18,21,23 and 33 is shown in FIG. 4. Other timing is discussed later. Referring still to FIG. 3, pulses from clock and counter 124 are first reduced in frequency by binary counter 126. One of the outputs from counter 126 is selected by switch 49; its positive-going transition triggers a short positive pulse from one-shot 37 which is transmitted on lead 60 to the mixturastat. The mixturastat is shown in FIG. 8.

Figure 8:
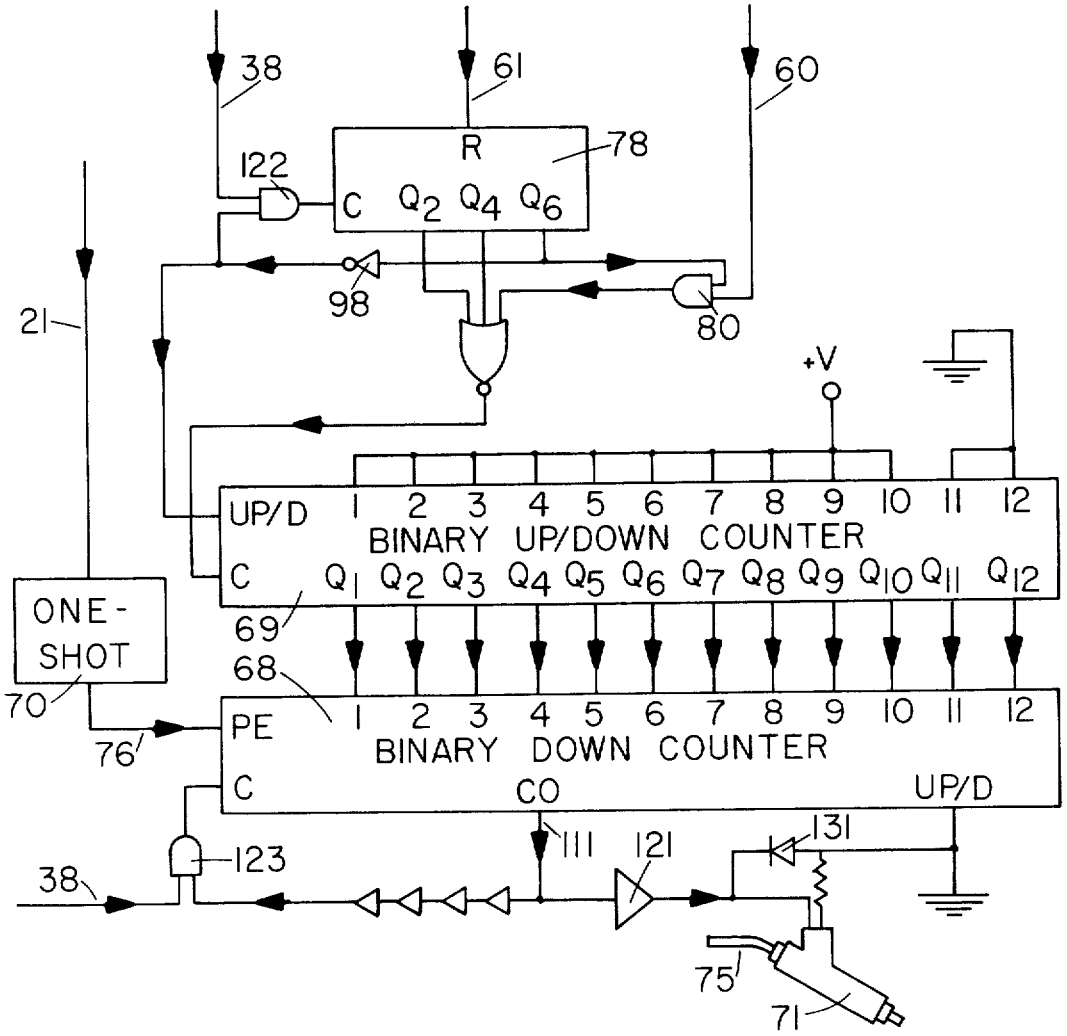
FIG. 8 diagrams the mixturastat.

Referring to FIG. 8, down counter 68 is preset to the number in up/down counter 69. The fuel metering valve 71 is held open while counter 68 is counting down to zero from its preset number. When counter 68 reaches the count of zero its output lead 111 goes to ground potential, inhibiting the clock input to the down counter and closing fuel valve 71. Once during each combustion cycle, when lead 21 goes positive, one-shot 70 is triggered to produce a short positive output pulse which presets counter 68. Immediately thereafter, fuel valve 71 is opened and counter 68 starts counting down again to zero count.

Referring still to FIG. 8, a misfire is signaled by a short positive pulse received on lead 61 from the energy discriminator. This pulse resets counter 78, which immediately starts to count cycles of the fuel control oscillator, received on lead 38. Counter 78 is a Johnson counter with eight decoded outputs including $Q_2$, $Q_4$, and $Q_6$. Positive output pulses from $Q_2$, and $Q_4$ provide two counts upward on up/down storage counter 69 whenever the cylinder misfires. Counter 78 proceeds then until it gives a positive output from $Q_6$ at which point its clock input is inhibited at AND gate 122. When $Q_6$ of counter 78 is positive, AND gate 80 is enabled so that positive pulses from lead 60 can count downward on storage counter 69.

Storage counter 69 is a 16 stage binary counter; it counts downward one count on pulses received on lead 60 and upward two counts whenever a single pulse is received on lead 61. The sixteen binary outputs from storage counter 69 are then used to preset the fuel rationing counter 68.

The clock input to counter 68, entering on lead 38, is transmitted from the air pressure sensor. The optimum fuel ration for each combustion cycle is dependent on the amount of air taken into the cylinder in that cycle, which is directly dependent on the absolute pressure in the air induction tube. The air pressure sensor is shown in FIG. 2.

Referring to FIG. 2, manifold absolute pressure transducer 29 converts the air pressure into a voltage on lead 119. The transducer is a variable capacitance type, model P609-5A, marketed by Kavlico Corp. The output voltage V is given approximately by the equation:

$$V - V_1 = K.P.V_+ \quad (1)$$

where $V_1$ is an offset voltage,

P is the absolute pressure,

K is a constant of proportionality, $V_+$ is the upper power supply potential.

This voltage V is to be converted into the period T of an oscillator.

Referring still to FIG. 2, operational amplifier 130 together with resisters R and $R_1$–$R_4$ constitute a fixed current source as described in National Semiconductor Corporation Application Note 29, Dec. 1969, page AN29-14. This current source produces a small constant current through resistor R which gradually charges capacitor C toward the output potential V, on lead 119 from the pressure transducer. As soon as the capacitor potential exceeds V, the output of amplifier 26 goes to near ground potential. This jerks the capacitor potential back down to a voltage $V_2$ near ground potential. Now the output of amplifier 26 goes high, so that it is cut off from the capacitor by diode 95, and the capacitor slowly charges up again. Since the capacitor is being charged upward most of the time, its period T is given approximately by the equation:

$$T = (V - V_2) \cdot RC / V_+ \quad (2)$$

The offset voltage $V_1$ of equation (1) is made equal to the offset voltage $V_2$ of equation (2) by adjustment of resistors 105 and 106 in FIG. 2, thereby making the period of the fuel control oscillator proportional to the pressure in the air intake manifold. Resistor R is set so that the maximum oscillator period, corresponding to open engine throttle at sea level, is about six microseconds.

The duration of the rationing pulse is proportional to the period of the fuel control oscillator, but the exact number of oscillator periods in a rationing pulse is adjustable in the mixturastat. This adjustment is made automatically, depending on information from the energy discriminator, which is diagramed in FIG. 5.

Figure 5:
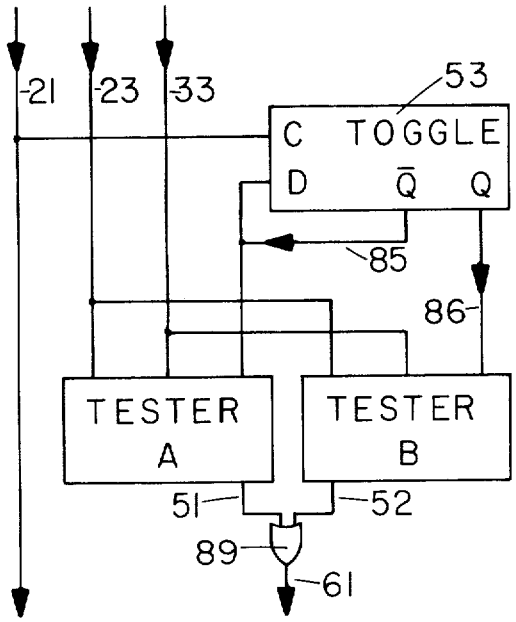
FIG. 5 diagrams the energy discriminator.

Referring the FIG. 5, a positive pulse is received on input lead 21 during each combustion cycle. This pulse switches toggle 53 so that its true output Q becomes alternately high and low on successive combustion cycles. The true output is transmitted on lead 86 to tester B, while the complementary output $\overline{Q}$ is transmitted on lead 85 to tester A.

When a misfire occurs in a combustion cycle, it is detected by tester A or tester B, depending on whether lead 85 or 86 is high during that combustion cycle. If the misfire is detected by tester A, its output lead 51 goes momentarily high. On the other hand, if a misfire is detected by tester B, its output lead 52 goes momentarily high. All misfire signals are collected by OR gate 89 and transmitted on discriminator output lead 61 to the mixturastat.

Timing of the signals on leads 85 and 86 is indicated in FIG. 4. Except for their connection to toggle 53, testers A and B are identical; each comprises a decelerometer for detecting an abnormal momentary deceleration of the crankshaft. Tester A is diagramed in FIG. 7

Figure 7:
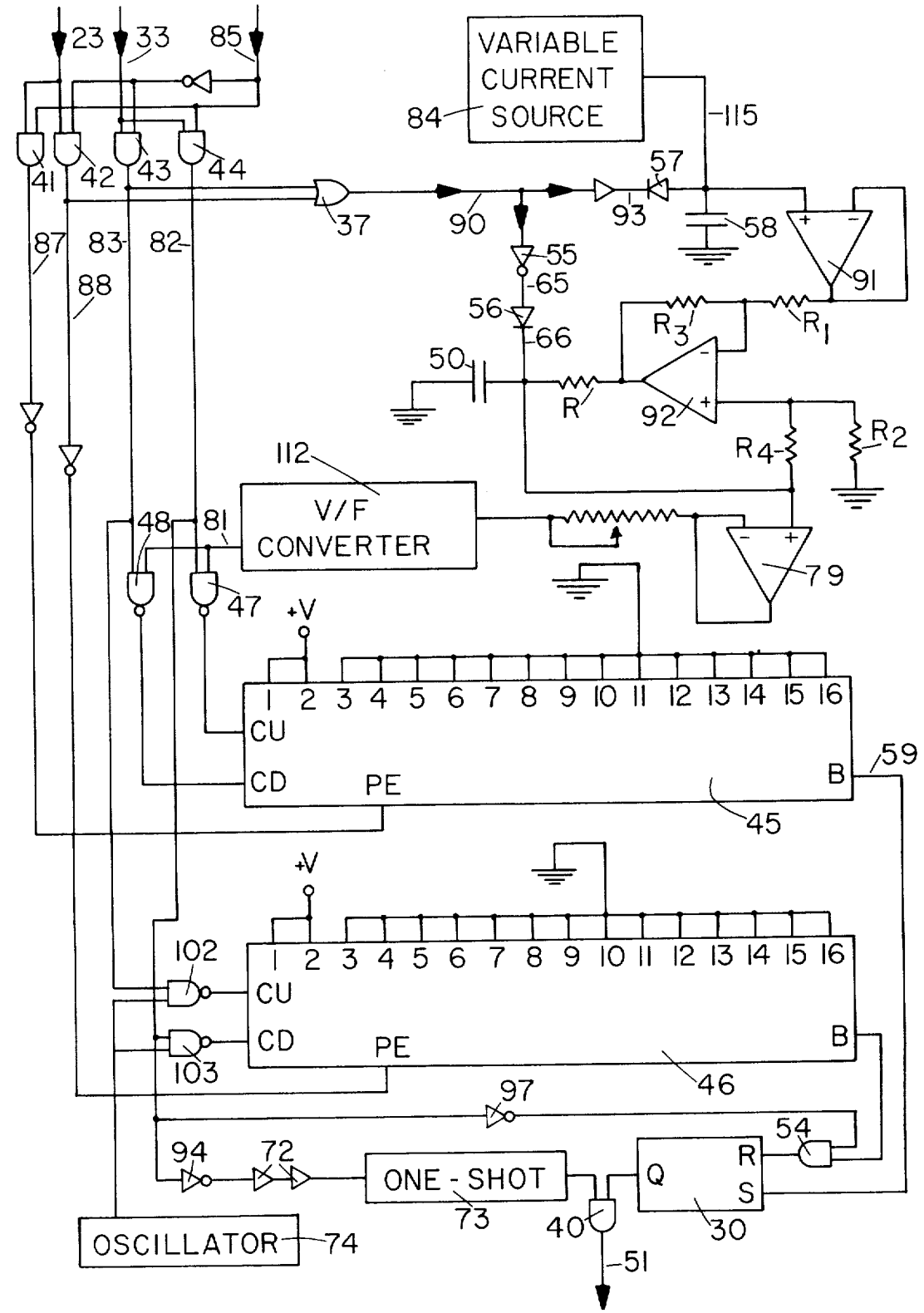
FIG. 7 diagrams tester A in the energy discriminator.

Referring to FIG. 7, lead 85 carries a signal from the toggle in the energy discriminator. When this signal is high, gates 41 and 44 are enabled and gates 42,43 are disabled. Consequently the inputs to OR gate 37 will be low, its output lead 90 and lead 93 will be low, so that capacitor 58 will be held near ground potential. Voltage follower 91 will transmit this low potential to current source 92, which transmits a positive output current through resistor R to capacitor 50. At the same time the low potential of lead 90 is inverted by inverter 55. This acts through diode 56 to ensure that capacitor 50 is held near the upper power supply potential.

Figure 6:
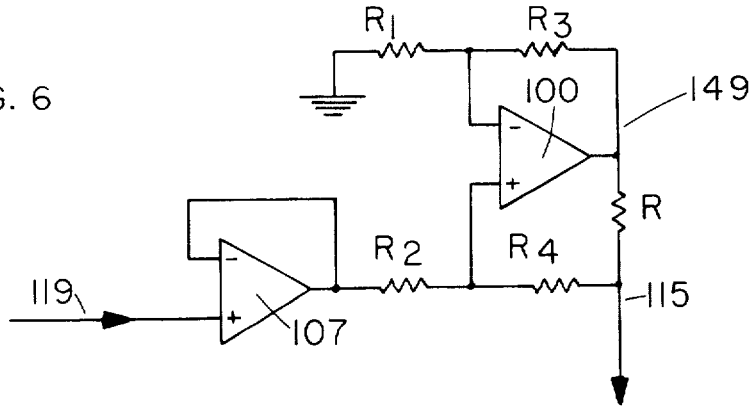
FIG. 6 diagrams a variable current source for the energy discriminator.

During the next combustion cycle, lead 85 will be low so that AND gates 42,43 will be enabled. Then when lead 23 or 33 goes high it will make leads 90 and 93 high. Lead 93 is then disconnected from capacitor 58 by diode 57, so that the small current from current source 84 can raise the voltage across capacitor 58 at a rate that depends on the pressure of the engine intake air. Details of this variable current source are shown in FIG. 6.

Referring still to FIG. 7, the rising voltage across capacitor 58 is transmitted through voltage follower 91 to variable current sink 92. These current source and sink circuits are described in National Semiconductor Corp. Application Note 29, Dec. 1969, page AN29-14. Because of inverter 55, lead 65 is low, being isolated from lead 66 by diode 56. Thus variable current sink 92 is freed to drop the voltage across capacitor 50 by an amount which increases as the square of the time.

The diminishing voltage is converted into a diminishing frequency by voltage-to-frequency converter 112, which clocks the test counter 45, shown in FIG. 7.

The maximum frequency of clock 112 is 1.6 MHz. Each of the test counters can count up to 65,535, giving a maximum test period of 0.041 second. This corresponds to an engine speed of 244 RPM. At most engine speeds the test count will be much lower than 65,000.

In order to test for misfires, crankshaft speed during each power stroke is compared with that of the preceding and succeeding power strokes. For sixty degrees of crankshaft travel during each power stroke, lead 33 in FIG. 7 goes high. If lead 85 is already high, then AND gate 44 is enabled, so that when lead 33 goes high NAND gate 47 will be enabled, connecting clock 112 to the clock-up input of test counter 45. Leads 93 and 66 hold capacitor 50 at its uppermost potential, so that clock 112 maintains its maximum frequency of 1.6 MHz. At the end of the sixty degree test interval, lead 33 goes low and the clock-up count is disabled.

At the beginning of the next power stroke, lead 85 will be low. When lead 23 goes high the frequency of clock 112 will start to drop. At sixty degrees into this power stroke, lead 33 goes high and the clock frequency continues to drop. Since lead 85 is now low, AND gate 43 is enabled so that when lead 33 goes high NAND gate 48 is enabled. This starts test counter 45 to count down. If the cylinder does not misfire, the test counter will not have time to count down to zero, and there will be no low signal transmitted on borrow lead 59 to set NAND latch 30. Thus AND gate 40 will remain disabled and no misfire signal can be transmitted on lead 51. Test counter 45 will be reset by the next high on lead 23.

Should the engine misfire, producing a deficient quantum of energy, the engine will slow sufficiently that counter 45 will have time to count down to zero. At that moment, its borrow output on lead 59 goes low, setting NAND latch 30 and enabling AND gate 40. Thus when the negative-going transition on lead 82 triggers one-shot 73, its positive output pulse can be transmitted on lead 51.

If the engine deceleration should be due to an increased load or to throttling of the air intake, then the following power stroke would also be slowed. In order to test for these external causes of deceleration, test counter 46 counts the cycles of fixed-frequency oscillator 74. Counter 46 counts up and then down during the intervals when lead 33 is high. If the deceleration is due to an increased load or to throttling the air supply, then counter 46 will have time to count down to zero. Its borrow output will then go low, resetting NAND latch 30 before the negative-going transition on lead 33 can trigger one-shot 73. The positive output pulse of the one-shot will not be transmitted on 51. Test counter 46 will be reset by the next high on lead 23.

If the engine deceleration is due to a misfire, then during the next power stroke the deceleration will be reduced to a small value or reversed. Thus test counter 46 will not have time to count down to zero, and NAND latch 30 will not be reset. Thus one-shot 73 will transmit a positive pulse on lead 51 indicating a misfire. This positive pulse will act on the mixturastat to increase the fuel ration.

Since counter 46 starts counting up from a small positive preset value, and then counts down to zero, the down count will take slightly longer than the up count. Thus even if the engine decelerates a little during the next power stroke of the cylinder, the timing pulse on lead 44 may terminate before counter 46 can reach zero count and send a signal out on its borrow lead to reset latch 30. In this case AND gate 40 will remain enabled so that a misfire signal, slightly delayed by buffers 72, can be transmitted on lead 31 to the mixturastat.

FIG. 7 shows counter 46 preset to a count of 3. If two more preset leads are connected to the positive power supply and the remainder are left at ground potential, the counter will be preset to a count of 15. If a total of six preset leads are made positive the counter will be preset to a count of 63. The preset count is preferably restricted to small numbers such as these in order to avoid false signals due to heavy engine braking or throttling. Thus a misfire signal will be transmitted to the mixturastat only when deceleration during the next power stroke of the cylinder has been reduced to a small or negative value. (A negative deceleration being an acceleration.)

Timing of the pulses on leads 82,83,87,88 is shown in FIG. 4. Timing of the output pulse from tester A on lead 51 is shown in the last line of FIG. 4. Variable current source 84 for tester A is diagramed in FIG. 6.

Referring to FIG. 6, lead 119 from the engine fuel control unit carries a voltage which is proportional to the pressure in the air induction tube. This voltage is transmitted through voltage follower 107 to op. amplifier 100, where it produces a proportional current through resistor R and lead 115 to capacitor 58, shown in FIG. 7.

This system of capacitors charged by variable current sources simulates the dynamics of a decelerating engine, so that misfires can be detected over a large range of engine speeds and intake air pressures. The correct size of capacitors 50 and 58 in FIG. 7 increases with the moment of inertia of the crankshaft assembly, including the flywheel and the propeller. If there is a gear box between the engine and the propeller, the effective movement of inertia of the propeller varies as the square of the gear ratio.

In FIGS. 1 to 8, reference numbers represent commercial components as follows:

40-44,54,80,122,123 represent AND gate CD4081B,
47,48,102,103 represent NAND gate CD4011B,
37,89 represent OR gate CO4071B,
72 represents buffer CD405OUB,
35,55,94,97,98 represent inverter CD4049UB,
19 represents Schmitt trigger CD4093B,
30 represents NAND latch CD4044B,
77 represents shift register CD4034B,
78 represents Johnson counter CD4022B,
124,126 represent counter/clock CD4060B,
45,46 represent UP/DOWN counters CD40193B,
68,69 represent binary counter CD4029B,
70.73,74 represent multivibrator CD4098B,
92,100 represent operational amplifier LM108,
26,79,91 represent operational amplifier CA3130B,
121 represents Darlington transistor MPSU45,
7,8 represent triggers OPTO XR-CD,
112 represents voltage-to-frequency converter 4707.

The LM108 operational amplifier is marketed by the National Semiconductor Corporation. The Darlington transistor is marketed by Motorola. The optical triggers are marked by Allison Automotive Company. The voltage-to-frequency converter is marketed by Teledyne Philbrick. The other integrated circuits are marketed by RCA.

This embodiment of my invention is sensitive to engine misfire at all engine speeds and intake air pressures. Thus at all engine speeds the mixturastat reaches a state of equilibrium in which there is a misfire once in every five or ten minutes, depending on the setting of switch 49 in FIG. 3.

If counter 126 in FIG. 3 is clocked by lead 21 instead of lead 125, it will count engine revolutions instead of time; the equilibrium frequency of misfires will then be proportional to engine speed. The cylinder can then be made to average one misfire in every 5000 or 10,000 revolutions depending on the setting of switch 49 in FIG. 3.

My invention is not limited to single cylinder engines nor to the type of decelerometer which has been described herein.

I claim:

1. An improved internal combustion engine having a combustion chamber, means for metering a series of air rations and for metering a corresponding series of fuel rations, means for mixing each one of the fuel rations with its corresponding member of the series of air rations and firing the resulting mixture in the combustion chamber so as to produce a quantum of energy, the resulting series of energy quanta being delivered to a power output shaft, the improvement comprising:

means for automatically reducing the size of members of the series of fuel rations while the size of the corresponding series of air rations is held constant, the average rate of fractional reduction of size of the fuel rations, when averaged over a thousand consecutive members of the series of fuel rations, not exceeding one half per thousand consecutive members of the series of fuel rations;

a decelerometer including a clock means for generating clock signals having at least two different frequencies and a digital counter for counting the clock signals from the clock means, for determining when a momentary deceleration of the shaft speed exceeds a threshold value, and when the excessive deceleration is immediately followed by a reduction of the excessive deceleration to a small value, the momentary deceleration being measured by counting up from a preset value on the digital counter at a first clock frequency during a first angular displacement of the shaft and then counting downward on the counter at a lower second clock frequency during a second angular displacement of the shaft, the threshold value for abnormal deceleration being determined at least in part by the frequency difference between the up count and the down count;

means for automatically increasing the size of succeeding members of the series of fuel rations when the decelerometer determines that the engine has produced a quantum of energy which is abnormally deficient compared to both the immediately preceding and the immediately succeeding members of the series of energy quanta, the single fractional increase in size of the fuel ration not exceeding one fifth when the size of the air ration is unchanged.

2. An internal combustion engine as recited in claim 1 having only one combustion chamber.

3. An internal combustion engine as recited in claim 1 wherein the second clock frequency is lower than the first clock frequency by a difference which increases with the period of the shaft rotation.

* * * * *